United States Patent [19]

Touhou et al.

[11] 4,417,172

[45] Nov. 22, 1983

[54] LOW PRESSURE DISCHARGE LAMP

[75] Inventors: Makoto Touhou, Yawata; Shigeaki Wada, Osaka; Minoru Yamamoto, Neyagawa, all of Japan

[73] Assignee: Matsushita Electric Works, Ltd., Kadoma, Japan

[21] Appl. No.: 215,664

[22] Filed: Dec. 12, 1980

[30] Foreign Application Priority Data

| | | | |
|---|---|---|---|
| Dec. 29, 1979 | [JP] | Japan | 54-171283 |
| Dec. 29, 1979 | [JP] | Japan | 54-171293 |
| Oct. 8, 1980 | [JP] | Japan | 55-141314 |

[51] Int. Cl.[3] ..... H01J 1/50

[52] U.S. Cl. ..... 313/156; 313/153; 313/485; 313/567

[58] Field of Search ..... 313/182, 156, 153

[56] References Cited

U.S. PATENT DOCUMENTS

| | | | |
|---|---|---|---|
| 2,217,415 | 10/1940 | McArthur | 313/156 |
| 2,478,446 | 8/1949 | Alfven | 313/156 |
| 3,562,583 | 2/1971 | Zollweg | 313/156 |
| 4,311,942 | 1/1982 | Skeist et al. | 313/156 |

*Primary Examiner*—Harold Dixon

*Attorney, Agent, or Firm*—Cushman, Darby & Cushman

[57] ABSTRACT

The present invention purposes to suppress flickering phenomena which is caused by moving striation of rare gas discharge in a low pressure discharge lamp tube containing therein mercury and a rare gas; an apparatus for lighting a low pressure discharge lamp comprises a discharge tube and static magnetic field generating means, which is for instance a permanent magnet, disposed on the tube or around the tube, and generates a magnetic field to cross an electric field substantially all over the positive column in the tube.

6 Claims, 23 Drawing Figures

90
91
60
70
80
50
40
10
10'
30
20
L
L'

LOW PRESSURE DISCHARGE LAMP

BACKGROUND OF THE INVENTION

1. Field of the Invention

The present invention relates to an improvement in a low pressure discharge lamp having a discharge tube containing therein mercury and a rare gas, and requiring only about half as much commercial power source voltage being supplied to said discharge tube by using a stabilizer.

2. Description of the Prior Art

Generally speaking, argon gas as a rare gas is contained in a fluorescent discharge tube of a low pressure discharge lamp, such as fluorescent lamp. However, recently a new type of a low pressure discharge lamp having a discharge tube of smaller diameter containing therein mercury and a rare gas such as krypton or xenon, which has heavier atomic weight than argon, is proposed. In such discharge tube an energy loss which is caused by elastic collisions of atoms is reduced by enclosing the rare gas into the discharge tube. Since the rare gases of heavy atomic weight have a lower ionization potential, the mobility of a charged particle in the discharge tube is reduced. Accordingly, the cathode drop is reduced and efficiency of the lamp is improved. However, in the above-mentioned sort of fluorescent lamp, a flickering phenomena remarkably appears under the condition of a low ambient temperature, and as a result the lamp beam becomes low, and further more the stabilizer loss increases by an increasing of the load current.

The flickering phenomena is produced by a moving striation which is peculiar to rare gas discharge in the positive column, and the more heavy the atomic weight is, the more it appears to a higher temperature. The reason is assumed as follows: As the ambient temperature of the discharge tube drops, the mercury vapor pressure exponentially drops, and hence the majority of ions in the discharge tube gradually change from mercury ions to rare gas ions, and accordingly the moving striation caused by the rare gas discharge appears. However, when krypton (ionization potential is 13.99 V), which has the atomic weight heavier than argon (ionization potential is 15.76 V), is sealed in the discharge tube as the rare gas, because of its small ionization potential against mercury's (ionization potential is 10.43 V) the majority ions in the discharge tube gradually change from mercury ions to rare gas ions, even under the condition of a comparative high temperature where a small amount of mercury ions still remain in the discharge tube. In case that the rare gas sealed in the discharge tube is a mixing gas consisting of various rare gasses, the flickering phenomena is effected by the heaviest rare gas of the component gas. And hence the more the mixing ratio of the gas is the more prominent the flickering phenomena caused by the moving striation of the rare gas discharge appears under the condition of a comparatively high temperature.

SUMMARY OF THE INVENTION

The object of the present invention is to solve the abovementioned problem concerning the low pressure discharge lamp apparatus. The apparatus has magnetic field generating means such as permanent-magnet on a discharge tube itself or a discharge tube holding instrument, and the magnetic field generated by the magnetic field generating means is applied to the positive column which appears along almost the entire length in said discharge tube. Then the flickering phenomena of said discharge tube may be effectively suppressed by selecting the intensity of magnetic field within a particular limit.

BRIEF EXPLANATION OF THE DRAWINGS

FIG. 1(*b*) is a cross sectional front view through the L—L section of the discharge tube shown in FIG. 1(*a*).

FIG. 2(*b*) is a cross sectional front view through the L'—L' section of the discharge tube shown in FIG. 2(*a*).

DETAILED DESCRIPTION OF THE INVENTION

Figures 1, 2:
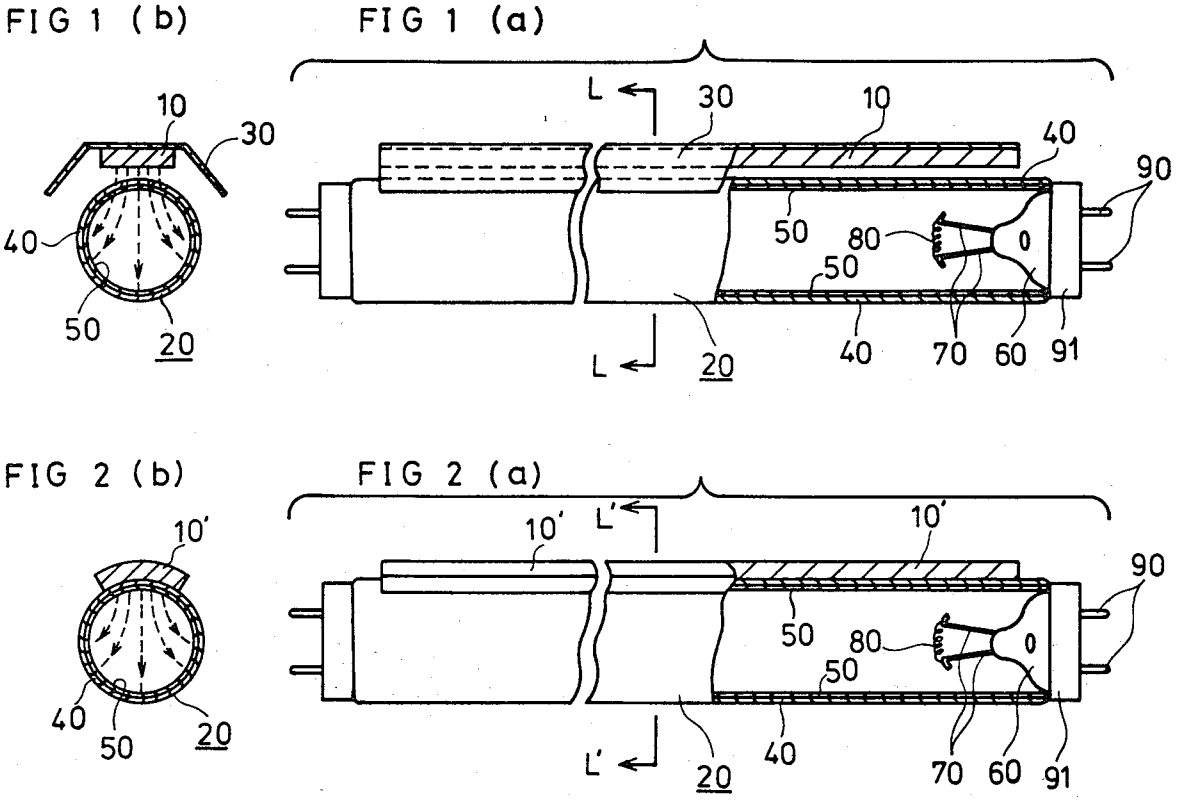
FIG. 1(*a*) is a partial sectional side view of a discharge tube of a preferred example of the present invention.
FIG. 2(*a*) is a partial sectional side view of a discharge tube of a preferred example of present invention.

Generally speaking, there are two types of flickering phenomena appearing in a low pressure discharge tube containing therein mercury and a rare gas and they are as follows. The first type of said flickering phenomena is a flickering appearing near electrodes which is caused by the flickering of the cathode dark space at a frequency which is twice the frequency of the power line. The said flickering phenomena appearing near the electrode is called end-flicker. The second type of flickering phenomena is a flickering appearing all over the positive column and is caused by the moving striation discharge which is peculiar to the rare gas. The first type of said flickering phenomena, i.e., and end-flicker, may be easily prevented by using a flickerless circuit. The present invention purposes to suppress the flickering of said second type, i.e., the flickering which appears all over the positive column. The present inventors made various experiments for the purpose of suppressing said flickering appearing all over their positive column. As a result of the experiments an effective method of applying a magnetic field to the electric field in the discharge tube almost all over the positive column was found. An illustrative apparatus in accordance with this invention, has a straight fluorescent discharge tube as the low pressure discharge tube and a rectangular parallelo-shaped ferrite permanent magnet, which is disposed lengthwise along substantially the whole length of the discharge tube, and is magnetized in the direction of a diameter of a circular section of the discharge tube.

Another apparatus in accordance with this invention has the straight fluorescent lamp and oblong plate-shaped ferrite permanent magnet having a section disposed on and curving along the surface of the discharge tube, magnetized in the direction of the diameter of the discharge tube and extending along substantially the whole length of said straight fluorescent discharge tube. The abovementioned construction of the present invention is described in detail hereinafter referring to the drawing, which shows preferred embodiments of the present invention.

Figure 3:
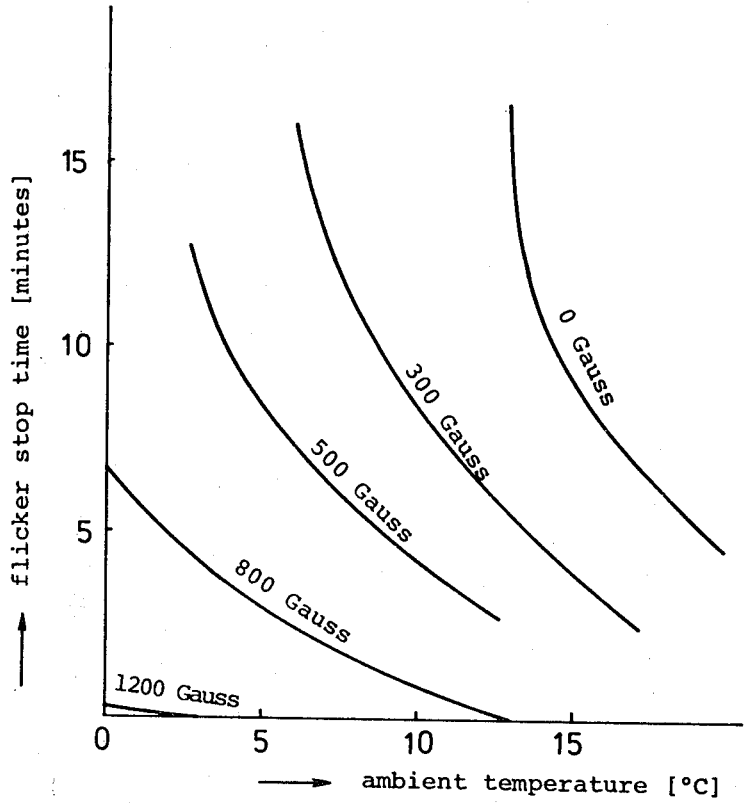
FIG. 3 is a graph of characteristic curves showing general relations between ambient temperature of the discharge tube and the amount of time (in minutes) flicker as a parameter of the magnetic field strength applied to the discharge tube.

FIG. 1(*a*) is a partial sectional side view of a discharge tube of a preferred example of the present invention. FIG. 1(*b*) is a sectional front view thru L—L section of the discharge tube shown in FIG. 1(*a*). In the FIG. 1(*a*), the rectangular parallelo-shaped ferrite magnet 10 magnetized in the direction of its thickness is shown, and the ferrite magnet 10 is attached to the underneath surface of a light reflector 30 provided above straight fluorescent discharge tube 20. The magnetic pole surface (i.e., the underneath face) of said ferrite magnet 10 is disposed to face the upper surface of said straight fluorescent discharge tube 20 with a present gap inbetween for a range of substantially the whole length thereof. The abovementioned fluorescent discharge tube 20 is such the type that rare gas and mercury are contained therein, and fluorescent material layer 50 is applied on the inner surrace of its glass tube 40. Stems 60 are concealed in the internal space of the tube 40 at both ends thereof, and filaments 80 are supported by lead wires 70, which are provided penetrating the stems 60. The filaments 80 are coated with electron-emitting substance and form the electrodes. Metal caps 91 with cap pins 90 are attached to both ends of said glass tube 40. FIG. 2(*a*) is a partial sectional side view of a discharge tube of another preferred example of the present invention. FIG. 2(*b*) is a sectional front view thru L'—L' section of the discharge tube shown in FIG. 2(*a*). In the FIGS. 2(*a*) and 2(*b*), however, a detailed description of the parts equivalent to FIG. 1's is abridged by taking the same number. A curved plate type ferrite permanent magnet 10' is magnetized in the direction of thickness thereof as shown in FIGS. 2(*a*) and 2(*b*). The ferrite magnet 10' is affixed to along the straight fluorescent discharge tube 20 for substantially the whole length of upper surface of the discharge tube. In FIG. 1(*b*) and FIG. 2(*b*), the magnetic flux distribution is shown with a dotted line. The inventors have examined the relationship between the ambient temperature and a time until the flicker stops for a straight fluorescent discharge tube of a diameter of 26 mm and a length of 1200 mm, containing mixed rare gas of krypton 75% and argon 25% at a pressure of 1.5 Torr operated under a magnetic field. And the inventors examined the relationship between the time period necessitated from initiation of lighting to a stop of the flickering all over the length of the tube and the ambient temperature of said discharge tube, taking as a parameter the magnetic field strength at a part of outer surface of said discharge tube and nearest from the magnet, and changing said magnetic field strength from 300 Gauss to 1200 Gauss. Curves shown in FIG. 3 show the result of the examination. As shown in FIG. 3, the flickering never stopped irrespective of the time period, under the ambient temperature of lower than 5° C., where the magnetic field strength supplied to the discharge tube is 300 Gauss. As shown in FIG. 3, in the case of the conventional apparatus without application of the magnetic field (0 Gauss), the flickering could not be stopped at all under the condition of the ambient temperature of the discharge tube of about 10° C. or lower. And yet, 5 to 10 minutes are required to stop the flickering under the ambient temperature of the discharge tube at room temperature (15° C.). On the contrary however, in case of the discharge lamp in accordance with the present invention operated under an applied magnetic field of, for example, 800 Gauss, the flickering stopped immediately after start action, in spite of the condition of the ambient temperature of under 10° C. Furthermore, the flickering stopped completely in 3 to 4 minutes under the ambient temperature of about 5° C. Thus the present invention has a great utility, and for the case using a magnet of 1200 Gauss of its field strength, the flickering stopped immediately after a starting action even in a very cold condition.

As shown in table 1, in the lamp of the present invention, the lamp efficiency is much improved. In comparing the conventional apparatus with the apparatus of present invention applied with the magnetic field of 500 Gauss, the lamp current of the present apparatus decreases by about 7% from the conventional one, and hence the stabilizer loss drops about 15%, and furthermore the intensity of the lamp beam improves by about 10%. Therefore, the lamp efficiency and the overall efficiency are much improved. The reason for the high efficiency is assumed to be as follows: the discharge path in the discharge tube is deflected towards the inner surface of the discharge tube, and hence the recombination of ions with electrons at the inner surface of the discharge tube is accelerated, and accordingly, the potential gradient of the positive column is improved, thereby improving the intensity of the luminescence of the discharge tube.

TABLE 1

| | conventional case (0 Gauss) | present case (500 Gauss) |
|---|---|---|
| lamp current | 100% | 92.6% |
| lamp voltage | 100% | 112.6% |
| lamp power | 100% | 105.1% |
| lamp beam output | 100% | 109.5% |

Figure 4:
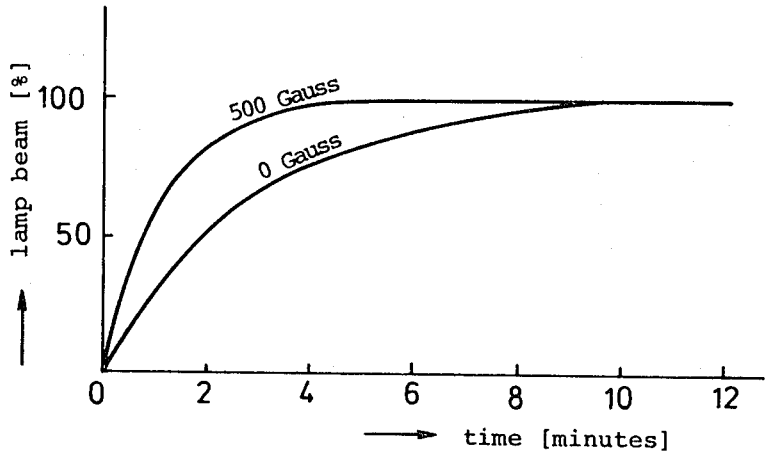
FIG. 4 is a graph of characteristic curves showing the light-up characteristics of the lamp flux present case (500 Gauss) as compared with that of the conventional case (0 Gauss).

The start-up characteristics of the lamp flux of present case (500 Gauss) is shown in comparison with that of the conventional case (0 Gauss) shown by a graph of characteristic curves in FIG. 4. As is easily observed in FIG. 4, in the conventional case where no magnetic flux is supplied, it takes about 10 minutes to reach a steady state (where the lamp beam is 100%). However, in the present case, it takes only 3–4 minutes to reach the steady state. That is the lamp of the present invention has very much superior start-up chracteristics.

As abovementioned referring to FIG. 3, the inventors have made various experiments, and obtained the knowledge that, concerning such apparatus using the magnetic field intercoursing the electric field in the discharge tube to suppress the flickering phenomena, the larger the magnetic flux density of the magnetic field applied, the more rapidly the flickering stops. But, on the other hand, it is known that there is a problem that the discharge tube can not start because the starting voltage of the discharge tube rises, or the discharge extinguishes when the discharge holding voltage rises too high due to an increase of the magnetic flux density of the applied magnetic field. The reason is assumed as follows: When the magnetic field is applied to the discharge tube along its lengthwise direction at right angles against the center axis of the discharge tube, the recombination of the ions with electrons at the inner surface of the discharge tube is improved, as the magnetic flux density of the applied magnetic field increases.

It is found that generally, the value of the magnetic flux density must be chosen in a particular limit to stop the flickering within a desired time and to ensure the easiness of the starting, under various conditions which are determined by the conditions of ambient temperature, power source voltage, kind of mixed rare gas contained in the discharge tube, mixing ratio of the rare gas and the inside pressure of the discharge tube. And yet it was not known hitherto that the general existence of the apparatus which can start certainly and can stop the flickering in a required time under the relatively severe conditions of ambient temperature and power source voltage. The present inventors have made various experiments for the purpose of making the above-mentioned apparatus, and found the values of the magnetic flux density which are suitable to stop the flickering and to certainly start the discharge under the various conditions. The above-mentioned experiment and its results are described fully thereafter.

Concerning an ilustrative fluorescent discharge tube (i.e., tube 1) of the 40 watts class type using 100% krypton gas as the rare gas contained in the discharge tube, and the other example (i.e., tube 2) of an energy saving type 40 watts class using 60% argon gas and 40% kripton gas as the rare gas contained in the discharge tube, the following experimental results are obtained.

Figure 5:
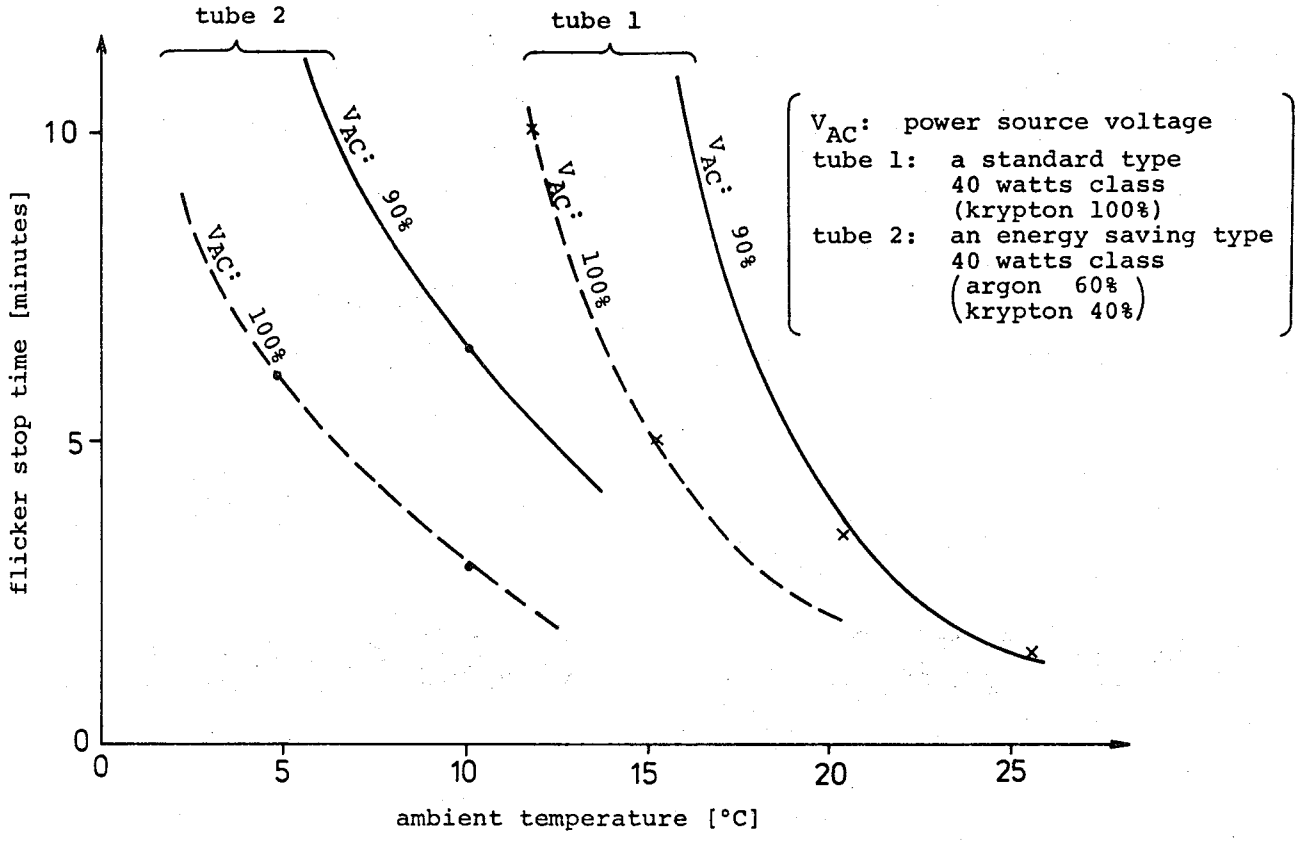
FIG. 5 is a graph of characteristic curves showing the general relationship between the ambient temperature of the discharge tubes lit without the application of magnetic field and the time (in minutes) required to stop flickering referred to herein as the flicker stop time taking as a parameter of the power source voltage actually supplied.

The general relationships between the ambient temperature of the discharge tube and the time from the start of the discharge to the stop of the flickering (i.e., flickering stop time) under a zero magnetic field are shown in characteristic curves graph of FIG. 5. As shown in FIG. 5, for the same discharge tube under the same actually supplied power source voltage, the lower the ambient temperature is, the longer the flickering stop time is; and for the same discharge tube under the same ambient temperature, the lower the power source voltage is, the longer the flickering stop time is.

Figure 6:
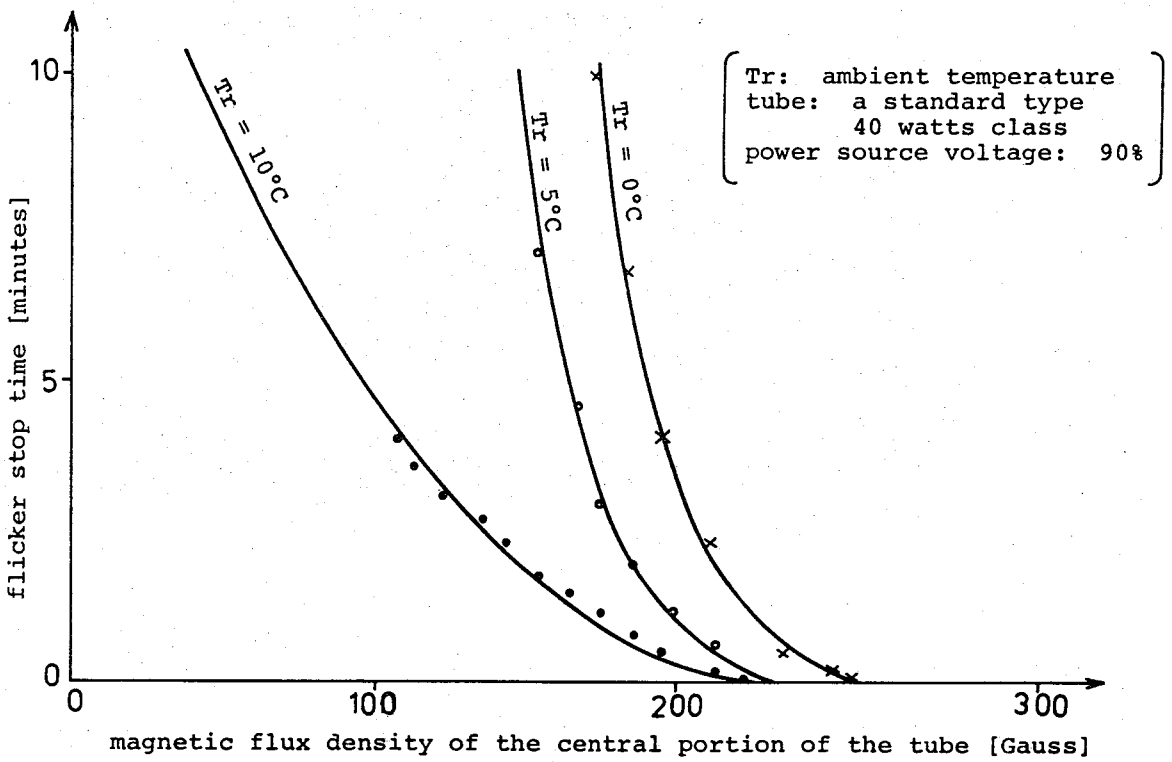
FIG. 6 is a graph of characteristic curves showing the relationship between the magnetic flux density at the central portion of the discharge tube and the flicker stop time as a parameter of the ambient temperature.

Then, concerning the same kind of the discharge tube, it is found that the relationship between the magnetic flux density at the central portion in the transverse section of the discharge tube and the flickering stop time, taking the ambient temperature Ta of the discharge tube as parameter, of an example of a 40 watt class fluorescent discharge tube is shown by the characteristic curves of FIG. 6. The higher the magnetic flux density of central portion of the discharge tube is, the shorter the flickering stop time is; but the lower the ambient temperature is, the higher the magnetic flux density of the central portion of the discharge tube required for the same flickering stop time.

In addition, it is also found that the abovementioned magnetic flux density of the center portion of the discharge tube is substantially equal to the mean value of the magnetic flux densities in a transverse section of the discharge tube. And after many experiments in these lamps, the inventors experimentally obtained the important knowledge that a value of the magnetic flux density at the central portion of the transverse section of the discharge tube may be used for practical purpose, in place of the value of average magnetic flux density in a section of this discharge tube, and based on the knowledge, the present invention was accomplished.

Figure 7A:
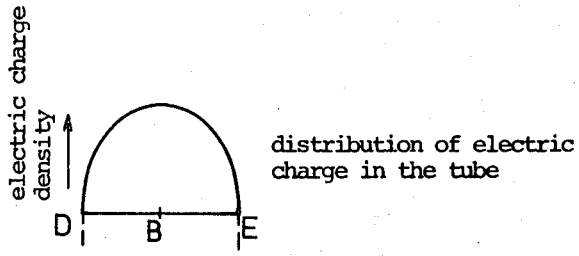
FIG. 7(*a*), (*b*) and (*c*) are schematic representations to explain the distribution of the electric charge, the distribution of the magnetic flux density, and the measuring points in the discharge tube.
Figure 7B:
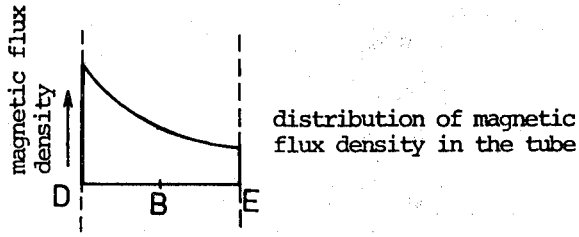
Figure 7C:
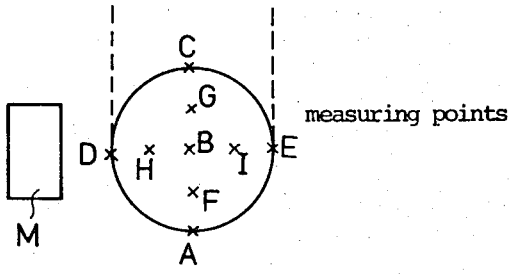

Generally, the electric charge density distribution in the direction of the diameter of the discharge tube may be expressed by the zero degree Bessel function. So, the electric charge density distribution generally has a pattern that the peak value of the density is in the center B of a transverse section of the discharge tube, and the density becomes lower as a position becomes near the inner surface of the discharge tube, as shown in the curve of FIG. 7(*a*), which is a chart of distribution of the electric charge density in the discharge tube. In other words, the electric charge concentrates to the central portion of the discharge tube. Hence, for suppressing the flickering, it is effective to apply the magnetic field to the central portion and therearound of the discharge tube, where the electric charge concentrates. Generally, the density of the magnetic flux generated by the magnetic field generating means M is in inverse proportion to the distance normally from the surface of the magnetic field generating means M, as shown in FIG. 7(*b*), which is a chart of the distribution of the magnetic flux density in the discharge tube. The inventors measured the magnetic flux density of the following points shown in FIG. 7(*c*): a point B center of a transverse section of the tube, a point D the nearest point to the magnetic field generating means M and on the inner surface of the tube, a point E a farest point from the magnetic field generator M and on the inner surface of the tube, a point A and a point C both ends of a diameter orthogonal to the diameter $\overline{DE}$, a point F a midway point of a segment $\overline{BA}$, a point G a midway point of a segment $\overline{BC}$, a point H a midway point of a segment $\overline{BD}$, and a point I a midway point of a segment $\overline{BE}$. It is found from the measurement that the value of magnetic flux density of the point B is substantially equal to a mean value of the flux densities at the points A to I.

Thus, it is found that using the value of the magnetic flux density at the central portion of the transverse section of the discharge tube is effectively equivalent to a use of the mean value of the magnetic flux densities of a transverse section of the discharge tube for the practical purpose. Accordingly, the magnetic flux density at the central portion of the transverse section of the discharge tube is used for convenience, in the abovementioned sense.

As mentioned referring to the FIG. 5 and the FIG. 6, there is a tendency that the lower the power source voltage is and the lower the ambient temperature is, the more severe the condition to stop the flickering becomes. And also, in general there is a tendency that the lower the power source voltage is and the ambient temperature is, the more severe the condition to start the discharge becomes.

Figure 8:
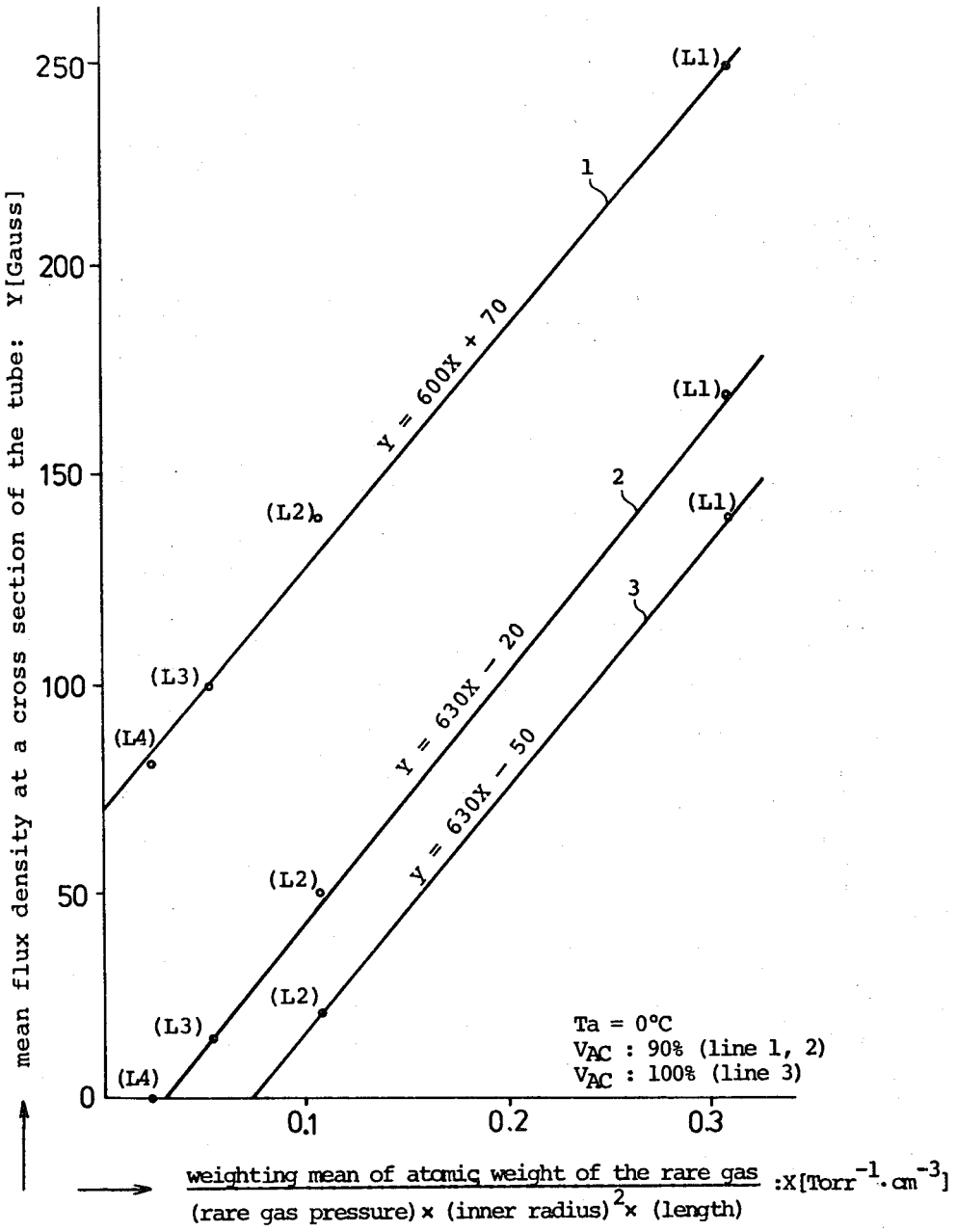
FIG. 8 is a graph of characteristic curves to explain the critical meanings of the numerical limitations of various quantities of this invention.

The inventors made various experiments under the ambient temperature of the discharge tube Ta=0° C. and the actually supplied power source voltage $V_{AC}$ is 90% of the scheduled standard power source voltage. This condition is assumed to be the most severe condition to stop the flickering and to start the discharge, and examined the limit of conditions to stop the flickering within 10 minutes and the limit of conditions to start the discharge. Then the remarkable results shown by the graph of characteristic curves of FIG. 8 are obtained.

The limit conditions to stop the flickering within 10 minutes are selected based on an empirical finding that when the flickering does not stop after elapsing 10 minutes from the start of the discharge the flickering not stopped finally.

The specifications of the representative discharge tubes examined under abovementioned experiments, the magnetic flux density at the center B of a transverse section of the discharge tube at the limit condition (upper limit) to start the discharge, and the magnetic flux density of the center B at the limit condition (lower limit) to stop the flickering within 10 minutes are shown in the belowmentioned Table 2.

TABLE 2

| Tube | Details | | Magnetic flux density upper limit | Magnetic flux density lower limit |
|---|---|---|---|---|
| L1 | rare gas in the tube: | krypton (100%) | 250 Gauss | 170 Gauss |
| | pressure in the tube: | 1.5 Torr | | |
| | length of the tube: | 1198 mm | | |
| | inner radius of the tube: | 12.5 mm | | |
| L2 | rare gas in the tube: | neon (21%) argon (38%) krypton (41%) | 140 Gauss | 50 Gauss |
| | pressure in the tube: | 2.3 Torr | | |
| | length of the tube: | 1198 mm | | |
| | inner radius of the tube: | 13.5 mm | | |
| L3 | rare gas in the tube: | argon (60%) krypton (40%) | 100 Gauss | 15 Gauss |
| | pressure in the tube: | 1.3 Torr | | |
| | length of the tube: | 2367 mm | | |
| | inner radius of the tube: | 19 mm | | |
| L4 | rare gas in the tube: | argon (100%) | 80 Gauss | 0 Gauss |
| | pressure in the tube: | 2.0 Torr | | |
| | length of the tube: | 2367 mm | | |
| | inner radius of the tube: | 19 mm | | |

Tube L1: a standard type 40 watts class tube
Tube L2: an energy saving type 40 watts class
Tube L3: an energy saving type 110 watts class
Tube L4: a standard type 110 watts class FIG. 8 is a graph of characteristic curves based on the data on the table 2. In FIG. 8, X is a value of the quotient obtained by dividing the weighted mean value of the atomic weight of rare gas atoms in the discharge tube by a product of pressure value in the tube, square value of the inner radius of the tube and the length of the tube. That is:

$$X = \frac{\text{weighted mean value of atomic weight of rare gas atoms in the tube}}{(\text{pressure in the tube}) \times (\text{inner radius of the tube})^2 \times (\text{length of the tube})} \; [\text{Torr}^{-1} \cdot \text{cm}^{-3}] \quad (1)$$

Let us consider the physical meaning of the X as follows: By defining:

$P_g$: pressure in the tube
$V_{lamp}$: volume in the tube
$N_g$: total number of rare gas atoms in the tube
R: gas constant
T: temperature of the rare gas at as sealed in the tube [°K.]
r: inner radius of the tube
l: length of the tube from the Boyle-Charle's law, the following equation holds:

$$P_g \cdot V_{lamp} = N_g \cdot R \cdot T,$$

and hence $$N_g = \frac{P_g \cdot V_{lamp}}{R \cdot T} \quad (2)$$

$$\propto P_g \cdot V_{lamp} = P_g \cdot \pi \cdot r^2 \cdot l \propto P_g \cdot r^2 \cdot l.$$

From the equations (1) and (2), it is recognized that the denominator in the equation (1) is a value porportional to the total number of rare gas atoms in the tube. Accordingly, the value X is (proportional to) a mean value of an atomic weight of rare gas atoms in the discharge tube. And Y is a value of applied magnetic flux density at the center of a transverse section of the discharge tube, and the value Y is substantially equal to the mean value of magnetic flux density in a transverse section of the discharge tube, as elucidated above. In consideration of FIG. 8, it is recognized that under the condition of the ambient temperature Tr=0° C. and the actually supplied power source voltage of 90% of the scheduled standard poower source voltage, the limit conditions to start the discharge exist on the straight line 1, which is expressed by $$Y = 600X + 70.$$

In FIG. 8, at a zone existing under the straight line 1, the discharge tube can start certainly. And the limit conditions to stop the flickering within 10 minutes are on the straight line 2, which is expressed by $$Y = 630X - 20.$$

Hereupon, at a zone above the straight line 2 (i.e., a zone where magnetic flux density is higher than the flux density on the straight line 2), the flickering certainly stops.

Therefore, in a zone defined by $$600X + 70 > Y > 630X - 20 \quad (X > 0,\ Y > 0) \quad (3)$$

the discharge tube can start the discharging certainly and can stop the flickering within 10 minutes, nevertheless under the condition of the ambient temperature Tr=0° C. and the actually supplied power source voltage $V_{AC}$ of 90% of the scheduled standard power source voltage it cannot.

As can be assumed from FIG. 5 and FIG. 6, the zone in which the flickering may be stopped within 10 minutes extends downwards from the straight line 2, under the condition that the ambient temperature Ta is higher than 0° C. and the power source voltage is substantially 100% of the working voltage.

The inventors experimentally obtained the data shown in Table 3, and found the abovementioned zone wherein the flicker stop time is within 10 minutes at the ambient temperature Ta=0° C. and for the power source voltage $V_{AC}$ of 100% of the working voltage.

TABLE 3

| Tube | Details | Magnetic flux density lower limit |
|---|---|---|
| L1 | the same in table 2 | 140 Gauss |
| L2 | the same in table 2 | 20 Gauss |

In FIG. 8, the zone based on the data of table 3 is shown as a zone above the straight line 3 of $$Y=630X-50$$

i.e.;

$$Y>630X-50(X>0,\ Y>0).$$

The condition of ambient temperature Ta=0° C. and the actually supplied power source voltage $V_{AC}$ of 100% of the scheduled standard power source voltage is less straight than the condition of the ambient temperature Ta=0° C. and the actually supplied power source voltave $V_{AC}$ is lowered to 90% of the scheduled standard power source voltage, not only in the view point of stopping the flickering but also in starting the discharge. Accordingly, it is obvious that in the zone under the straight line 1, wherein the discharge tube can start even in such severe condition of the ambient temperature Ta=0° C. and the $V_{AC}$ is 90% of the working voltage, the discharge tube can start under the condition of Ta=0° C. and $V_{AC}$ is 100%.

Hence, at a zone of $$600X+70>Y>630X-50 \quad (X>0,\ Y>0), \tag{4}$$

the discharge tube can start the discharge certainly and can stop the flickering within 10 minutes, under the condition of the ambient temperature Ta=0° C. and the actually supplied power source voltage $V_{AC}$ is 100% of the scheduled standard power source voltage.

The apparatus of this invention has a magnetic field generating means by which magnetic flux density of the inequity (3) at the central portion of the discharge tube is produced.

By using the magnetic field generating means, the discharge tube can certainly start the discharge and can stop the fickering within 10 minutes nevertheless unclear the condition of the ambient temperature Ta=0° C. and the actually supplied power source voltage $V_{AC}$ is 90% of the scheduled standard power source voltage. This condition is assumed to the most severe condition to start the discharge and to stop the flickering.

In addition, the flickering can be stopped and the discharge can be started under the condition of the ambient temperature Ta=10° C. and the actually supplied power voltage $V_{AC}$ is 100% of the scheduled standard power source voltage.

The inventors examined the most effective shape of the permanent magnet, in the case of appling the permanent magnet as the magnetic field generating means as shown in FIGS. 1(*a*) and (*b*).

Generally, an increase of the magnetic flux density at the central portion of the discharge tube induces a shortening of the flicker stop time (the time from the start of lighting to the stop of the flickering), and therefore, the index of improvement of the overall efficiency improves. The index of improvement of the overall efficiency is defined by a percentage of an increase of efficiency of the discharge tube to its efficiency without the use of the magnetic flux.

Figure 9:
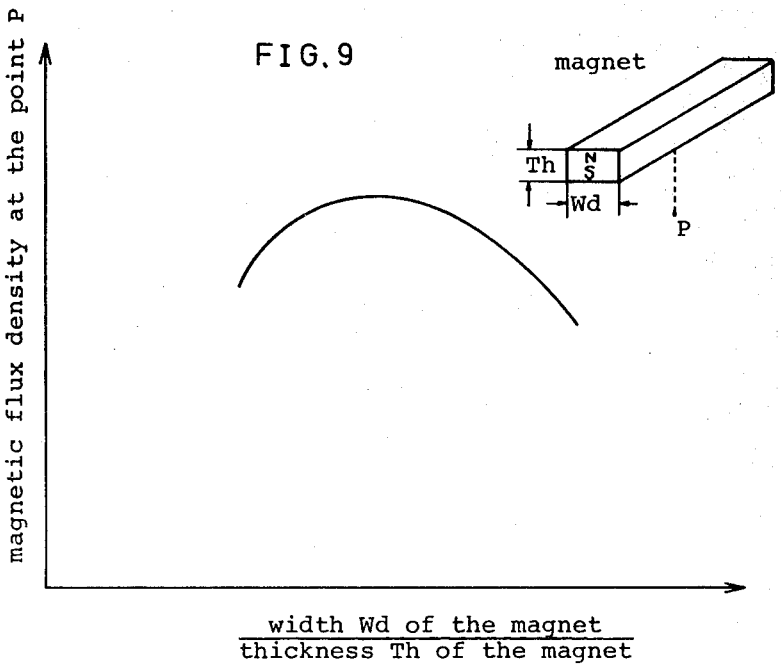
FIG. 9 is a graph of characteristic curves showing the relationship between the shape of the magnet and magnetic flux density at a point P with a predetermined distance from the center of the surface of the permanent magnet.

A relation between the shape of the magnet and a magnetic flux density at a point P with a predetermined distance from the center of the surface of the permanent magnet is shown by a characteristic curve of FIG. 9. In FIG. 9, the shape of the magnet is expressed by a proportion of width Wd of the magnet to the thickness Th of the magnet, keeping the volume and cross sectional area of the magnet constant.

Inventors paid an attention to the abovementioned characteristics, and made various experiments on the discharge tube L2 of the abovementioned details and the ferrite permanent magnet of a cross sectional area of 100 $mm^2$ and a length of 1000 mm. The experiments are made by varying the shape of the magnet, the magnetic flux density at the central portion of the discharge tube, the flickering stop time, and the index of improvement of overall efficiency, then data shown in Table 4 are obtained.

TABLE 4

| Shape of the magnet (thickness) × (width) | Flux density at the central portion of the tube | Flicker stop time | Index of improvement of overall efficiency |
|---|---|---|---|
| 6.5mm × 15.4mm | 83 Gauss | 6 minutes | 5% |
| 8mm × 12.5mm | 92 Gauss | 4 minutes | 7% |
| 10mm × 10mm | 87 Gauss | 5 minutes | 6% |

In table 4, the flicker stop time is measured at the ambient temperature of Ta=0° C. and the actually supplied power source voltage $V_{AC}$ of 90% of the scheduled standard power source voltage. And the index of improvement of overall efficiency is measured at Ta=25° C. and the $V_{AC}$ of 100% of the scheduled standard power source voltage.

Figure 10:
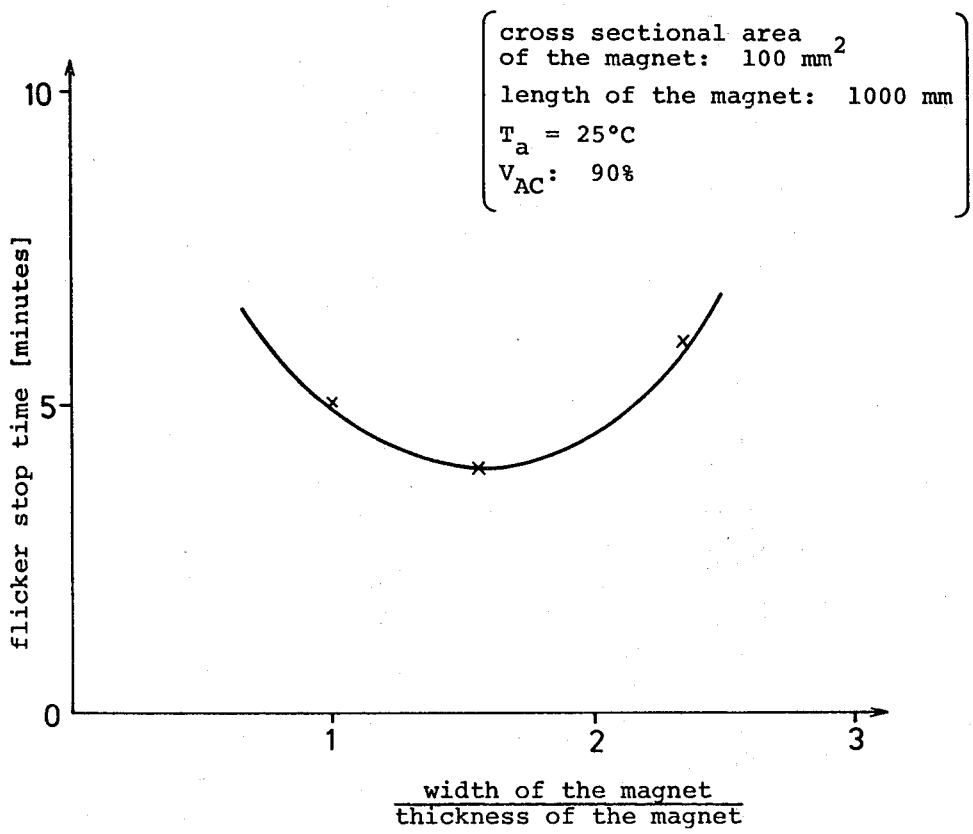
FIG. 10 is a graph of a characteristic curve showing the relationship between the shape of the magnet and the flicker stop time.

FIG. 10 is a graph of a characteristic curve drawn based on data of the table 4.

As is understood from the curve of FIG. 10, the permanent magnet becomes most effective to stop the flickering at the shape of the ratio of its width to its thickness of 1:2. And the abovementioned shape of the magnet is optimum to obtain a highest index of improvement of overall efficiency.

Because the abovementioned examinations of the shape of the permanent magnet are made with its cross sectional area and its length fixed constant (i.e. with a fixed constant volume), from a different point of view it may be said that the optimum shape of the magnet to minimize its cost is found.

Figure 11B:
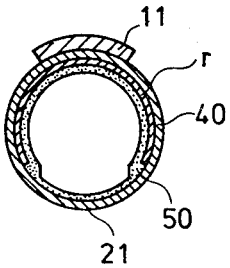
FIG. 11(*a*) to FIG. 19 are figures showing various examples of this invention.
Figure 11A:
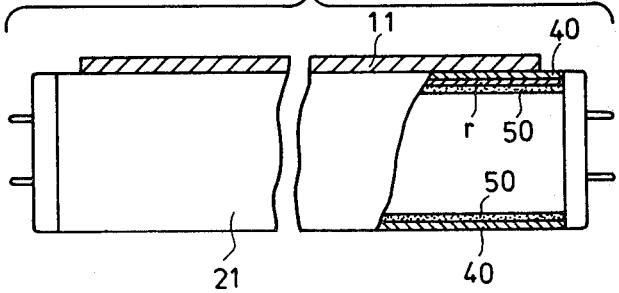

In addition, a low pressure discharge lamp with a reflector coating (hereafter called reflector tube) may be applied as the low pressure discharge tube. A partial sectional side view of the reflector tube is shown in FIG. 11(*a*), and a cross sectional view thereof is shown in FIG. 11(*b*). In FIGS. 11(*a*) and (*b*), a curved plate type ferrite permanent magnet 11' magnetized in the direction of thickness thereof, is affixed along the surface of straight reflector tube 21 for substantially the whole length of upper surface of the reflector tube. The reflector tube 21 has a reflective layer r on the inner surface of a glass tube 40 for substantially along the whole length of upper portion, which is covered by the curved plate type ferrite permanent magnet, of the tube 40. The reflector tube 21 has a fluorescent layer 50 on the whole inner surface of the tube 40 including the part of the reflective layer r.

Figure 12A:
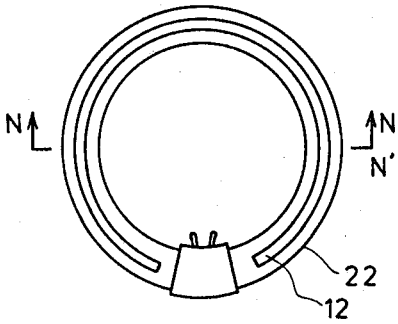
Figure 12B:
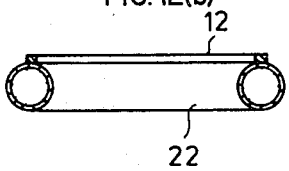

An apparatus using the reflector tube can reduce a light loss which is otherwise caused by the shielding of emission by the attached permanent magnet. A circular type discharge tube can be also manufactured by embodying the present invention. A plan view of the circular type discharge tube is shown in FIG. 12(*a*), and a sectional view taken on the sectional plane N—N of FIG. 12(*a*) is shown in FIG. 12(*b*). In FIGS. 12(*a*) and (*b*), the circle fluorescent lamp 22 has a circular plate type permanent magnet 12 also curved along the curvature of the tube 22 and fixed on the upper surface of the tube, that is, the magnetic field generating means is disposed on a portion of outer surface of said discharge tube and lengthwise along substantially whole length of the discharge tube.

Figure 13A:
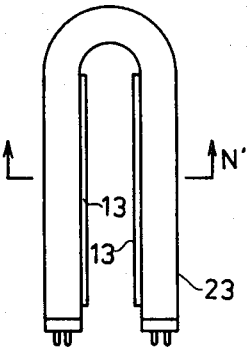
Figure 13B:
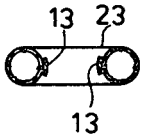

The still another embodiment, a U type discharge tube may be produced by embodying the present invention. A plan view of the U type discharge tube is shown in FIG. 13(*a*), and a sectional view taken on a sectional plane N′—N′ of FIG. 13(*a*) is shown in FIG. 13(*b*). In FIGS. 13(*a*) and (*b*), the U type discharge tube 23 has two parallelo-shaped permanent magnets 13, 13 attached to the inside surface of straight portion of the tube 23.

Figure 14A:
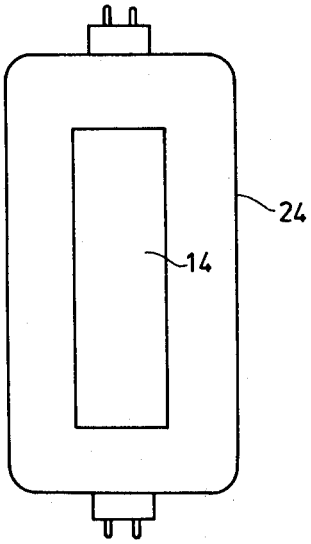
Figure 14B:
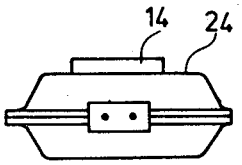

Furthermore, a parallelo-shaped discharge tube can be also manufactured by embodying the present invention. A plan view of the parallelo-shaped discharge tube is shown in FIG. 14(*a*), and a front view thereof is shown in FIG. 14(*b*). In FIGS. 14(*a*) and (*b*), the parallelo-shaped discharge tube 24 has a flat plate type permanent magnet 14 attached to the central upper surface of the discharge tube 24.

Figure 15:
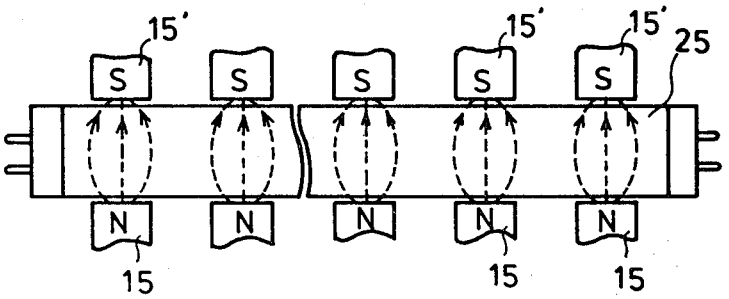

Many types of magnetic field generating means can be produced by embodying the present invention. A type of the magnetic field generating means is shown in FIG. 15. In FIG. 15, two rows of permanent magnets 15, 15, . . . and 15′, 15′ . . . are disposed with certain pitches on both sides of the discharge tube 25, the permanent magnets 15, 15, . . . and 15′, 15′, . . . opposing each other with their opposite magnetic polarity face.

Figure 16:
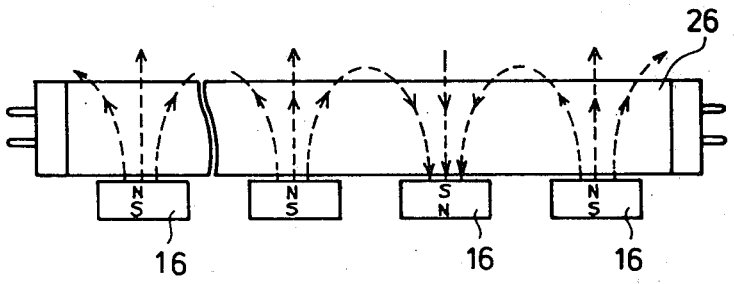

Still another type of the magnetic field generating means is shown in FIG. 16. In FIG. 16, several permanent magnets 16, 16 are disposed in a single row with certain pitches with their magnetic pole faces to the surface of the discharge tube 26, and each of their neighboring magnetic poles being in opposite directions.

Figure 17:
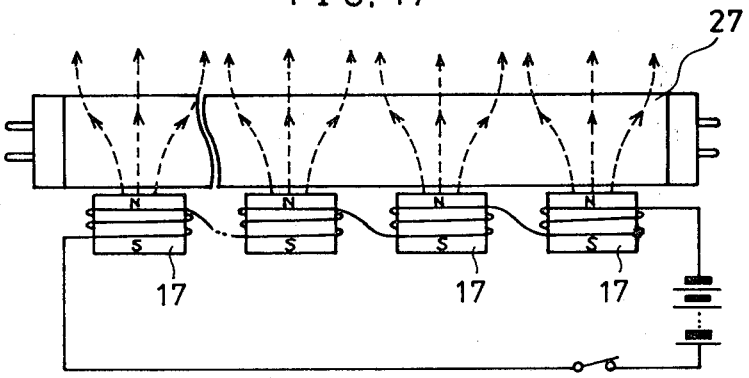

And another type of the magnetic field generating means is shown in FIG. 17. In FIG. 17, several electro magnets 17, 17 are disposed in single row with a certain pitches with their magnetic pole faces with their same poles to the surface of the discharge tube 27. As an alternative embodiment, the neighboring magnet may be disposed with each of their neighboring magnetic poles in opposite directions. In this case the magnetic flux distribution is similar to that shown in FIG. 16.

In FIGS. 15, 16 and 17, magnetic flux distribution is diagramatically shown by dotted lines and curves.

Figure 18:
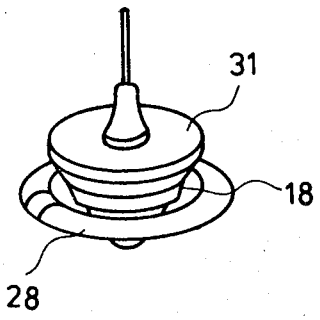
Figure 19:
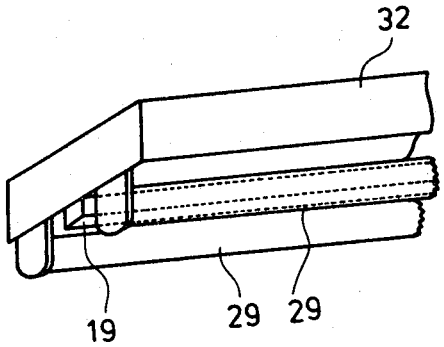

Still another type of magnetic field generating means using permanent magnet are shown in FIG. 18 and FIG. 19. In FIG. 18, a belt type permanent magnet 18 is bonded on an outer surface of a reflector 31 which is also used as a cover of a stabilizer, and a magnetic field produced by the permanent magnet 18 is effectively applied to a discharge tube 28. And in FIG. 19, a parallelo-shaped permanent magnet 19 is attached to a lower face, serving as a reflective surface, of a box type lamp instrument 32, which has tube holders for two tubes and the permanent magnet 19 is between the two tubes 29, 29 held by the instrument 32.

What we claim is:

1. A low pressure discharge lamp apparatus comprising:

a low pressure discharge tube, having electrodes on both ends thereof and containing therein mercury and a rare gas, and a magnetic field generating means disposed along said low pressure discharge tube for applying a static magnetic field such that its magnetic field crosses the electric field induced in said discharge tube when lit, for a range over substantially the entire length of a positive column induced in said discharge tube, wherein:

the value X of the quotient obtained by dividing the weighted mean value of the atomic weight of rare gas atoms in said discharge tube by a product of the pressure value in the tube, the square of the value of the inner radius of said discharge tube, and length of the tube, and the value Y of the applied magnetic flux density at the center of a transverse section of said discharge tube, have a relationship defined by the expression:

$$600X+70>Y>630X-20(X>0,\ Y>0)$$

in which the ambient temperature of said discharge tube is 0° C. and the power source voltage actually supplied is 90% of the scheduled standard power source voltage.

2. The low pressure discharge lamp apparatus in accordance with claim 1 wherein said magnetic field generating means is disposed on an instrument adapted to hold said low pressure discharge tube lengthwise along substantially the whole length of a surface of said discharge tube.

3. The low pressure discharge lamp apparatus in accordance with claim 1 wherein said magnetic field generating means is a parallelo-shaped permanent magnet having a ratio of thickness to width of about 1:2.

4. The low pressure discharge lamp apparatus in accordance with claim 1 wherein said rare gas is a mixed gas containing argon or a rare gas having an atomic weight heavier than argon.

5. A low pressure discharge lamp apparatus comprising:

a low pressure discharge tube, having electrodes on both ends thereof and containing therein mercury and a rare gas, and a magnetic field generating means disposed along said low pressure discharge tube for applying a static magnetic field such that its magnetic field crosses the electric field induced in said discharge tube when lit, for a range over substantially the entire length of a positive column induced in said discharge tube, wherein:

the value X of the quotient obtained by dividing the weighted mean value of the atomic weight of rare gas atoms in said discharge tube by a product of the pressure value in the tube, the square of the value of the inner radius of said discharge tube, and length of the tube, and the value Y of the applied magnetic flux density at the center of a transverse section of said discharge tube, have the relationship defined by the expression:

$$600X+70>Y>630X-50(X>0,\ Y>0)$$

in which the ambient temperature of said discharge tube is 0° C. and the power source voltage actually supplied is 100% of the scheduled standard power source voltage.

6. A low pressure discharge lamp apparatus comprising:

a low pressure discharge tube, having electrodes on both ends thereof and containing therein mercury and a rare gas, and having a reflective layer on the inner surface of said discharge tube substantially along the whole length of upper portion thereof, and having a fluorescent layer on the entire inner surface of said discharge tube including the part of said reflective layer, and a magnetic field generating means disposed along said low pressure discharge tube for applying a static magnetic field such that its magnetic field crosses the electric field induced in said discharge tube when lit, for a range over substantially the entire length of a positive column induced in said discharge tube, said magnetic field generating means being a curved plate-type permanent magnet affixed along the outer surface of said discharge tube, positioned substantially on a reverse side of said reflective layer and disposed substantially along the entire length of said discharge tube.

* * * * *